US011599063B2

(12) United States Patent
Papi

(10) Patent No.: US 11,599,063 B2
(45) Date of Patent: Mar. 7, 2023

(54) TIMEPIECE COMPRISING A VARIABLE-PITCH DISPLAY

(71) Applicant: Manufacture d'Horlogerie Audemars Piguet SA, Le Brassus (CH)

(72) Inventor: Giulio Papi, La Chaux-de-Fonds (CH)

(73) Assignee: MANUFACTURE D'HORLOGERIE AUDEMARS PIGUET SA, Le Brassus (CH)

( * ) Notice: Subject to any disclaimer, the term of this patent is extended or adjusted under 35 U.S.C. 154(b) by 388 days.

(21) Appl. No.: 16/778,217

(22) Filed: Jan. 31, 2020

(65) Prior Publication Data

US 2020/0249627 A1 Aug. 6, 2020

(30) Foreign Application Priority Data

Feb. 1, 2019 (CH) ..... CH00120/19

(51) Int. Cl.
*G04B 19/24* (2006.01)

(52) U.S. Cl.
CPC ..... *G04B 19/241* (2013.01)

(58) Field of Classification Search
CPC .... G04B 19/241; G04B 13/00; G04B 13/001; G04B 19/02; G04B 19/24
See application file for complete search history.

(56) References Cited

U.S. PATENT DOCUMENTS

| | | | | |
|---|---|---|---|---|
| 9,727 A * | 5/1853 | Hawes | G04B 19/241 368/37 |
| 4,974,242 A * | 11/1990 | Vuilleumier | G04B 19/268 368/37 |
| 2006/0098535 A1* | 5/2006 | Marki | G04B 19/247 368/37 |
| 2009/0040880 A1* | 2/2009 | Ruchonnet | G04B 19/20 368/233 |
| 2011/0203512 A1* | 8/2011 | Baker | B60K 37/02 116/284 |
| 2013/0340552 A1* | 12/2013 | Zaugg | G04B 35/00 74/409 |
| 2016/0223991 A1* | 8/2016 | Kojima | G04B 19/241 |

FOREIGN PATENT DOCUMENTS

| | | |
|---|---|---|
| CH | 702 847 A1 | 9/2011 |
| CN | 101055463 A | 10/2007 |
| CN | 102455653 A | 5/2012 |
| DE | 17 69 783 | 7/1958 |
| EP | 3 026 504 | 9/2017 |
| WO | WO 2017/144931 | 8/2017 |

OTHER PUBLICATIONS

Search Report, CH 1202019, dated Jun. 18, 2019.

* cited by examiner

*Primary Examiner* — Edwin A. Leon
*Assistant Examiner* — Jason M Collins
(74) *Attorney, Agent, or Firm* — Nixon & Vanderhye

(57) ABSTRACT

A timepiece, that includes a display mechanism arranged to control the movements of a display organ with respect to an indication scale including different indications having at least two different widths and being separated from one another by corresponding separation spaces, where the separation spaces all have substantially one and the same width.

20 Claims, 5 Drawing Sheets

TIMEPIECE COMPRISING A VARIABLE-PITCH DISPLAY

TECHNICAL FIELD

The present invention relates to a timepiece comprising a display mechanism arranged to control the movements of a display organ with respect to an indication scale comprising different indications having at least two different widths and being separated from one another by corresponding separation spaces.

STATE OF THE ART

Such timepieces have been well known for a long time in the prior art.

Thus, for example, the timepieces comprising a mechanism for displaying the date by a hand mostly conform to the above-mentioned features. In fact, while the indications of the twenties and the thirties can possibly have one and the same width, the indications of the tens can typically have a smaller width since the "1" has a lesser width than that of the "2" and/or of the "3", and the indications of the units typically have an even smaller width since they comprise only a single digit. These display mechanisms generally comprise a display organ driven via a conventional gear-train, to be moved with respect to the different indications with a constant movement pitch. Thus, the separation spaces situated between the indications have, for their part, a variable width to allow the display organ to be driven according to a constant pitch despite the variable width of the indications.

These constructions are the very reason why the corresponding indication scales have an irregular appearance, because the indications comprising two digits are tighter to one another than the indications of the units, this being more particularly marked for the twenties and thirties indications.

Moreover, the smaller the display surface for these indications, the more amplified is this irregular appearance. Thus, for example, the indications with two digits of the date appear particularly close to one another when the date is displayed in a small counter.

Disclosure of the Invention

A main aim of the present invention is to propose a timepiece that offers an alternative presentation with respect to the known timepieces in terms of display, notably an enhanced legibility.

To this end, the present invention relates more particularly to a timepiece of the type indicated above, characterized by the fact that the separation spaces all have substantially one and the same width.

By virtue of these features, the display associated with the mechanism according to the invention appears more uniform and more spaced out than the displays of the prior art and is consequently more legible than the latter.

Preferably, the display mechanism comprises

- a display mobile arranged to control the movements of the display organ, and
- an actuation mechanism arranged to cooperate with the display mobile and move it according to different successive positions associated with the indications, in such a way that the different successive positions have between them at least two different pitches.

According to a first preferred embodiment, the actuation mechanism can comprise a cam against which a feeler-spindle is arranged to bear, the feeler-spindle being linked kinematically to the display mobile, the cam having at least two different slope values along its length so that the display mobile can be driven in rotation according to two different pitch values for one and the same angle of rotation of the cam as a function of the orientation of the latter with respect to the feeler-spindle.

According to a second preferred embodiment, the actuation mechanism can comprise first and second partner wheels defining a non-circular meshing or a first partner wheel of a non-circular meshing, the display mobile comprising a second partner wheel of the non-circular meshing, the first and second partner wheels being arranged in such a way that they mesh with one another with a variable gear ratio, the display mobile being driven according to at least two different pitches.

According to a third preferred embodiment, the display mobile comprises gear teeth having at least two different pitches and arranged to cooperate, on the one hand, with an actuation mobile of the actuation mechanism and, on the other hand, with a jumper to ensure the holding of the position and/or of the orientation of the display organ, the gear teeth being indexed on the position of the indication scale.

In this case, the actuation mobile and the jumper are preferably arranged in such a way that the actuation mobile actuates one of the teeth with which the jumper cooperates to move the display member.

Furthermore, provision can be made for the gear teeth to have at least three different pitches.

In a particular variant embodiment, provision can be made for the gear teeth to be conformed in such a way that the widest tooth thereof has a width less than twice the width of the least wide tooth thereof.

Generally, provision can be made for the indications to indicate the date and/or, possibly, for them to have three different widths.

BRIEF DESCRIPTION OF THE DRAWINGS

Other features and advantages of the present invention will emerge more clearly on reading the following detailed description of a preferred embodiment, given with reference to the attached drawings given by way of nonlimiting example and in which.

EMBODIMENT(S) OF THE INVENTION

Figure 1A:
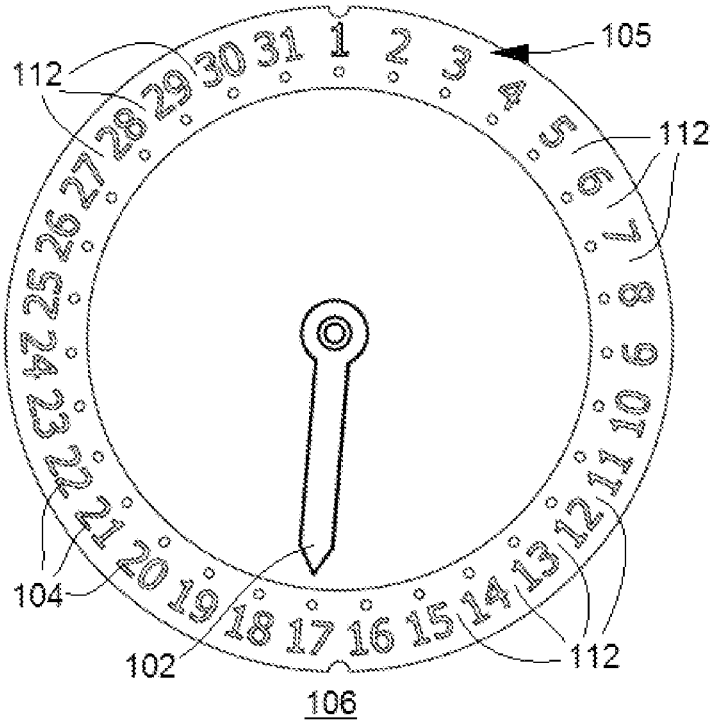
Fig. 1a (PRIOR ART)
FIGS. 1*a* and 1*b* represent one and the same simplified front view of a display for a timepiece respectively according to the state of the art and according to a preferred embodiment of the present invention.
Figure 1B:
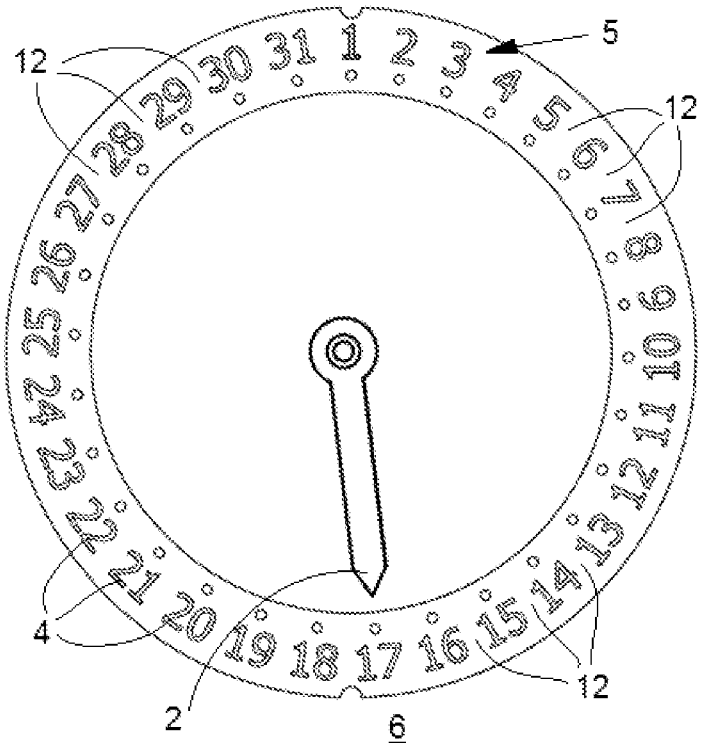

FIGS. 1*a* and 1*b* represent a simplified view of a display of a timepiece, respectively according to the state of the art and according to the present invention.

More specifically, FIG. 1*a* represents a date counter 106 according to the state of the art, intended to be incorporated in a dial of a timepiece. Said timepiece notably comprises a mechanism displaying the date arranged to display the value of the date by controlling the movements of a hand 102 with respect to indications 104 disposed along an indication scale 105, in the date counter 106.

By visually examining the indications 104, it can be seen that they have different widths, which is blatantly obvious when comparing, notably, the indications relating to the units with those relating to the tens, with those relating to the twenties or even with that relating to the thirties.

Typically, the hand 102 is borne by a date mobile (not visible) driven by a finger (not visible) to advance by at least one pitch per day, the finger being itself driven by a twenty-four-hour mobile (not visible). Such an arrangement allows the hand 102 to advance with constant pitch (without here considering the case of an annual or perpetual calendar mechanism which would allow the hand 102 to advance by several successive pitches at the ends of months of fewer than thirty-one days).

The different indications 104 are separated by separation spaces 112. It can be seen that the separation spaces 112 do not have the same width between two indications 104 associated with the units and between two indications 104 associated with the twenties, for example. This conventional feature is in fact intended to ensure that the pitch separating two successive indications 104 is the same all along the indication scale 105, in order for the positions of the indications 104 to be correctly associated with the different positions that the hand 102 can occupy because of its standard drive mode.

Such a display therefore offers a notable difference in the presentation of the values of the date between the start and the end of the indication scale, which may not be suitable to everyone from an aesthetic point of view and somewhat diminishes the legibility in the regions of the scale where the indications 104 are closer to one another. Obviously, while the aesthetic issue is equally present on a display arranged at the periphery of the dial, contrary to the issue of legibility, these two aspects become more striking as the display surface area concerned decreases.

Throughout the description, the term "width" denotes the dimension of the indication in the direction in which the indication scale extends, parallelly or tangentially to the indication scale depending on whether it extends rectilinearly or curvilinearly. In the embodiment presented, the indication scale is circular over an extent of 360° and the width of an indication is the dimension thereof in an orthoradial direction. This dimension can be expressed in the form of a distance or of an angle in the case of a curvilinear scale. Likewise, the separation spaces represent a dimension measured in the direction in which the indication scale extends such that, the length or the angular extent of the indication scale is the sum of the widths of the indications and of the separation spaces.

FIG. 1*b* represents a date counter 6 according to the invention, intended to be incorporated in a dial of a timepiece. According to a preferred embodiment of the present invention, said timepiece notably comprises a mechanism displaying the date arranged to display the value of the date by controlling the movement of a hand 2 with respect to indications 4 disposed along an indication scale 5 in the counter 6.

The indications 4 also have different widths, as is the case with the indications of the state of the art.

It can be seen that the separation spaces 12 this time all have sensibly the same width, whether it be between two indications 4 associated with the units or between two indications 4 associated with the twenties, for example. A perception that is more agreeable to the eye is thus obtained, by virtue of the regularity of the alterations between the indications 4 and the separation spaces 12 and it can also be seen that the legibility is increased with respect to the displays of the state of the art, more particularly in the twenties values.

The upshot of the above is that, to go from one indication 4 to the next, the hand 2 must be moved according to a certain pitch value, this value being a function of the width of the indications 4 concerned, so as to correspond to the irregular angular positioning of the indications along the indication scale. Thus, this pitch value will be, for example, smaller between two indications 4 associated with units of the date than between two indications 4 associated with twenties of the date.

To allow such an arrangement of the indications 4, the present invention preferably provides for the display mechanism to comprise a display mobile arranged to control the movements of the display hand 2, and an actuation mechanism arranged to cooperate with the display mobile and move it according to different successive positions associated with the indications 4, in such a way that the different successive positions have between them at least two different pitches.

Different constructions can be envisaged for the display mechanism for the hand 2 to be able to be moved in such a way that its different successive positions have between them at least two different pitches.

As a nonlimiting illustrative example, the actuation mechanism can comprise a cam against which a feeler-spindle is arranged to bear, the feeler-spindle being linked kinematically to the display mobile, the cam having at least two different slope values along its length such that the display mobile can be driven in rotation according to two different pitch values for one and the same angle of rotation of the cam as a function of the orientation of the latter with respect to the feeler-spindle.

As an alternative, provision can be made for the actuation mechanism to comprise first and second partner wheels defining a non-circular meshing or a first partner wheel of a non-circular meshing, the display mobile comprising a second partner wheel of the non-circular meshing, the first and second partner wheels being arranged in such a way that they mesh with one another with a variable gear ratio, the display mobile being driven according to at least two different pitches. Non-circular meshing should be understood, conventionally, to mean that it concerns a meshing between two partner wheels having a region of contact whose position, with respect to the centres of rotation of the partner wheels, depends on the angular orientation of the partner wheels.

Figure 2A:
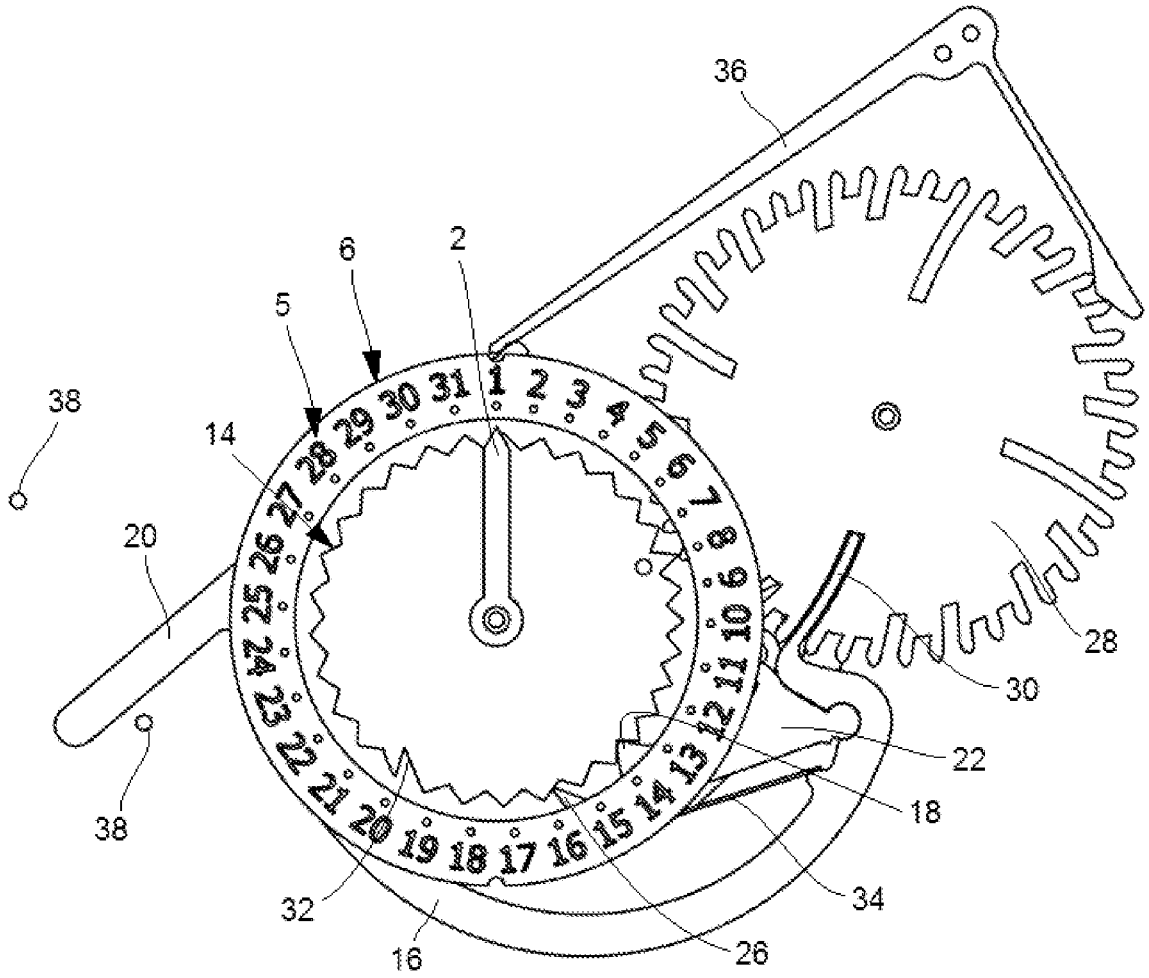
FIGS. 2*a* and 2*b* represent simplified front views of a part of a display mechanism in stand-by position according to a preferred embodiment of the present invention, respectively with and without display disc.
Figure 2B:
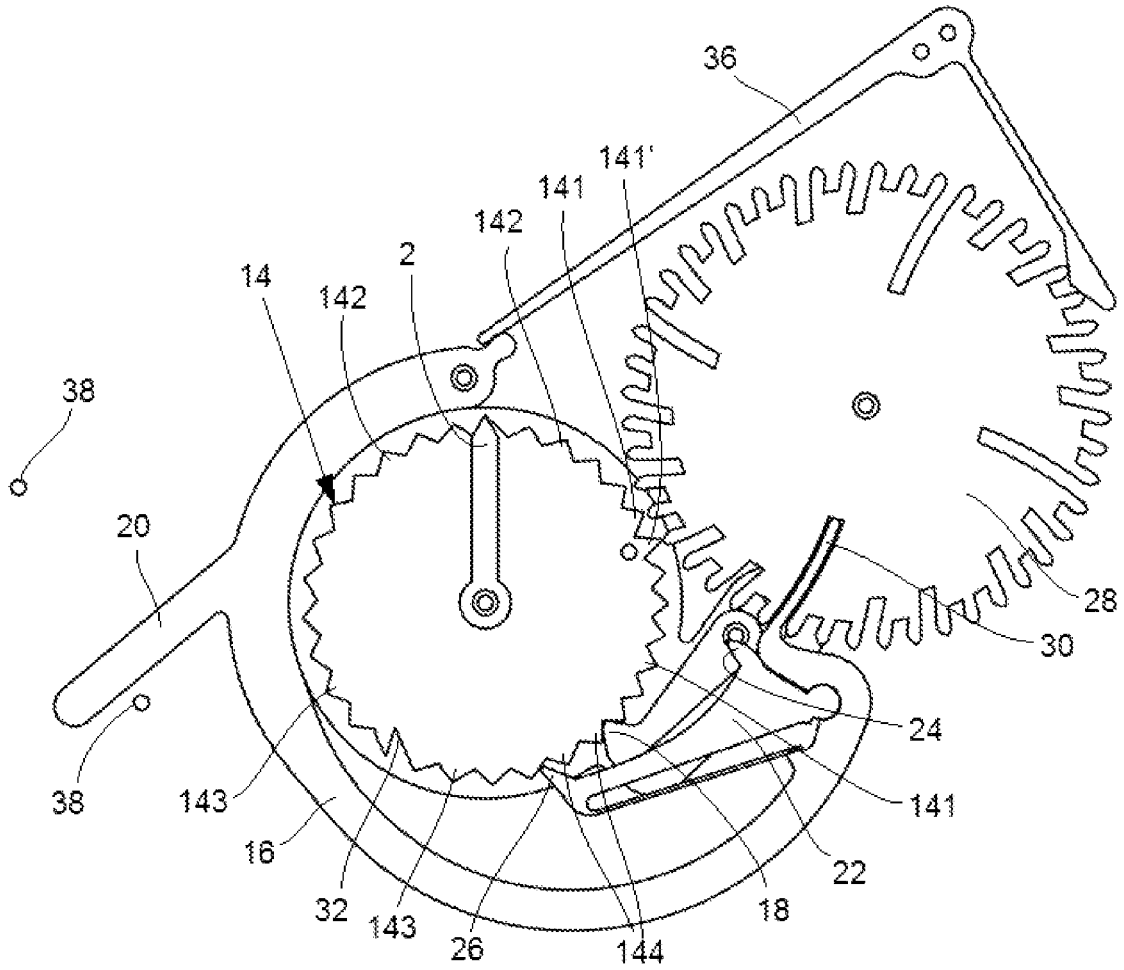
Figure 3:
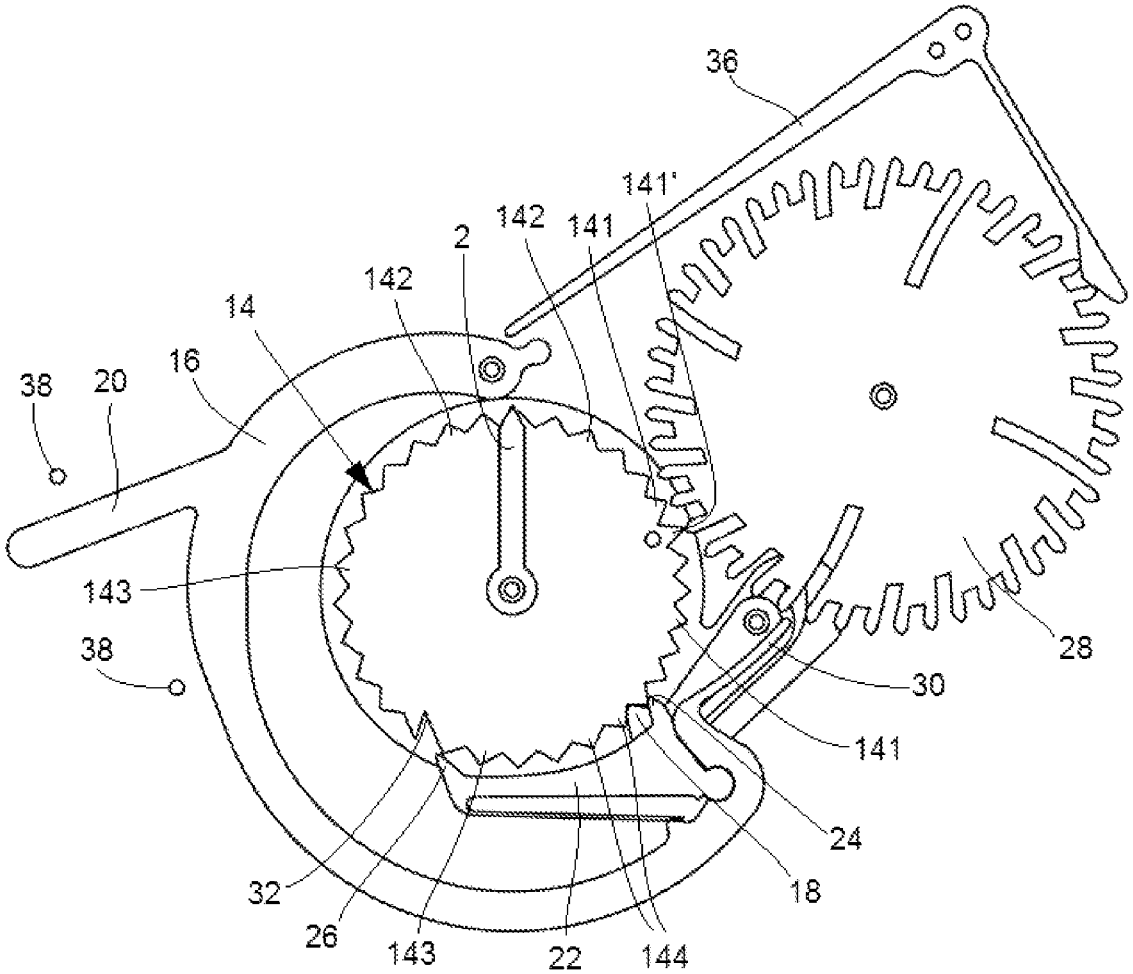
FIG. 3 represents the same mechanism, in a view similar to that of FIG. 2*b*, during a change of date.

According to an additional variant embodiment, illustrated partially and in simplified manner in FIGS. 2*a*, 2*b* and 3, provision is advantageously made for the display mobile to comprise gear teeth 14 having at least two different pitches and arranged to cooperate, on the one hand, with an actuation mobile 16 of the actuation mechanism and, on the other hand, with a jumper 18 to position and hold the display mobile, the gear teeth being indexed on the position of the indication scale 5.

The display mechanism partially illustrated in the figures is intended to display a perpetual calendar and its operation will not be fully described here in as much as the basic principle is already presented in the patent EP 3026504 B1, in the name of the Applicant. The display organ 2 is a hand which points to a date indication of the counter 6 by being secured to the display mobile.

The actuation mobile 16 here, by way of nonlimiting illustration, takes the form of an actuation lever, the latter being pivoted on an axis of rotation X1 with respect to the frame of the clockwork-movement.

The actuation lever comprises an arm 20 intended to receive pulses from a drive mobile (not visible) of the clockwork-movement to pivot the actuation lever, in the clockwise direction, and drive the display mobile in rotation.

To this end, the actuation lever bears a double beak 22 comprising first and second teeth 24 and 26 arranged to cooperate with the gear teeth 14 as described in the above-mentioned prior patent. The actuation lever cooperates in particular with a forty-eight cam 28, by means of a feeler-spindle 30, the forty-eight cam 28 comprising forty-eight notches of different depths and each of which corresponds to a given month out of the forty-eight months of a leap-year cycle.

As can be seen in FIG. 3, the first tooth 24 acts on the gear teeth 14 upon the transition from one day to the next until the last day of a given month. The second tooth 26 is intended to act on an appropriate void 32, formed in the gear teeth 14, to switch the date from the value of the last day of a given month to the first day of the next month when the current month has fewer than thirty-one days. The information concerning the number of days of the current month is read on the forty-eight cam 28 by insertion of the feeler-spindle 30 into a given notch, which defines the starting position of the actuation lever and therefore the pivoting extent thereof, as explained in the abovementioned prior patent.

The double beak 22 is borne by the actuation lever via a pivot link associated with a spring 34 so as to form a ratchet, that is retractable upon the return of the actuation lever.

A dual-positioning organ 36 ensures the holding of the respective angular positions of the forty-eight cam 28 and of the actuation lever when they are not driven in rotation.

The presence of two limiting abutments 38 will also be noted on either side of the arm 20 to prevent the actuation lever from being able to leave its functioning position.

The display mechanism according to the present invention is distinguished from the prior art by the fact that the hand 2 is moved according to variable pitches along the indication scale 5. Beyond other possible constructions like those mentioned above, it is possible to produce an appropriate drive of the hand 2 by producing gear teeth 14 having teeth of variable width.

The date hand 2 is positioned so as to point to the indication 4 corresponding to the first of the month in the configuration illustrated in FIGS. 2*a*, 2*b* and 3. The angular position of the display mobile is determined by the two teeth of the gear teeth 14 which cooperate with the jumper 18.

By closely examining the gear teeth 14, it can be seen that a first series of teeth 141, associated with the date units, has a first width and is followed by a second series of teeth 142, associated with the date tens, having a slightly greater width than that of the teeth 141 of the first series, the second series being followed by a third series of teeth 143, associated with the date twenties, whose width is very slightly greater than that of the teeth 142 of the second series, the third series being finally followed by two teeth 144 for the date thirties of a width substantially identical to that of gear teeth 143 of the third series.

Thus, when the actuation lever receives a pulse, its first tooth 24 exerts a pressure on the tooth of the gear teeth 14 situated immediately upstream of the jumper 18 to make the display mobile turn, as is illustrated in FIG. 3. In the configuration presented, it is important for the jumper 18 to be situated in proximity to the tooth of the gear teeth 14 intended to be driven by the first tooth 24 in order for the tooth intended to be driven to be indeed in the trajectory of the first tooth 24. In fact, the role of the jumper is not only to ensure the holding and the positioning of the display mobile with respect to the indication scale 5 but also to position the gear teeth 14 with respect to the actuation mobile 16.

Alternatively, it is possible, notably to simplify the construction and reduce the bulk, to place the jumper in another location by providing for the display mobile to comprise two distinct gear teeth, first gear teeth cooperating with the jumper, and second gear teeth cooperating with the display mobile. The first and second gear teeth have sequences of variations of angular pitch that are identical but have angular orientation and/or radii that are different. Note that, in the case of gear teeth with symmetrical teeth, it is preferable for the gear teeth 14 to be conformed in such a way that the widest tooth thereof has a width less than twice the width of the least wide tooth thereof. Such a limitation is not necessary in the case of asymmetrical gear teeth.

This principle of operation with variable pitch does not alter the nature of the action of the second tooth 26 of the actuation lever on the gear teeth 14, at the end of short months, compared to what was described in the abovementioned prior patent.

Similarly, the gear teeth 14 have a tooth 141' of a length greater than that of the other teeth so that it can cooperate with the forty-eight cam 28 once per month to make it advance from one month to the next.

Figure 4A:
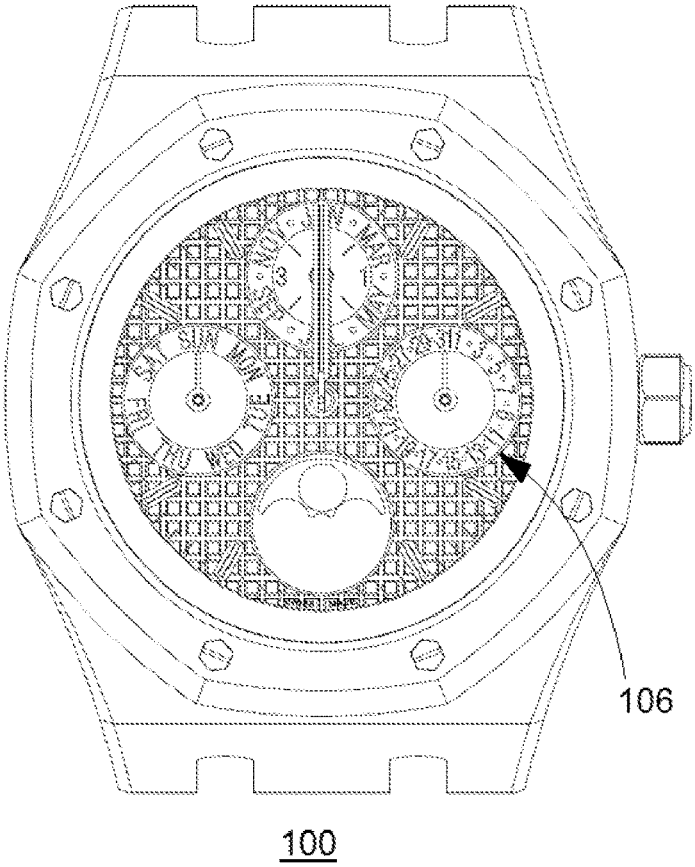
Fig. 4a (PRIOR ART)
FIGS. 4*a* and 4*b* represent one and the same simplified front view of a timepiece comprising a display respectively according to the state of the art and according to a preferred embodiment of the present invention.
Figure 4B:
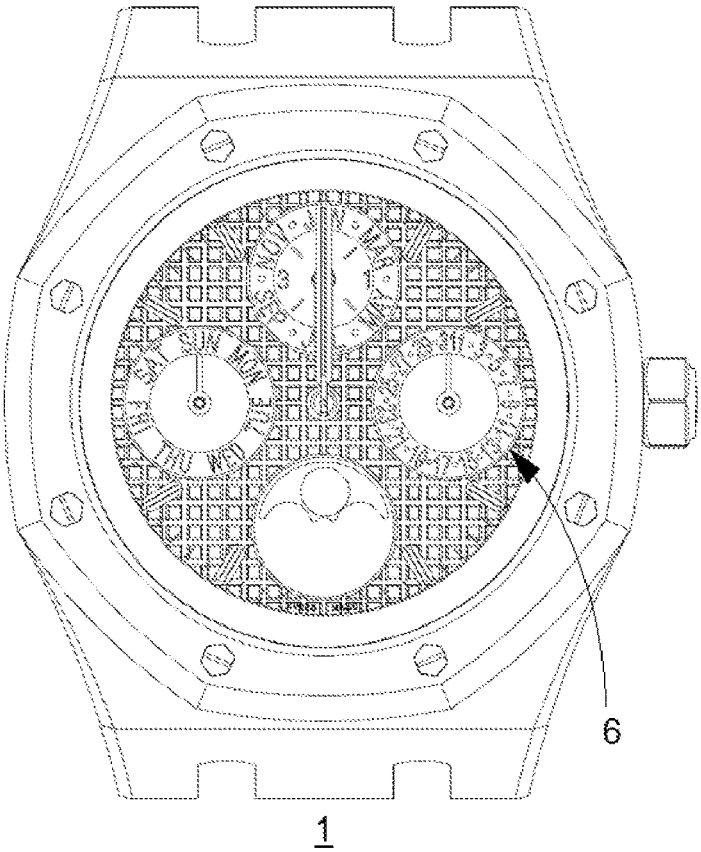

By virtue of the features which have just been presented, a qualitative display mechanism is obtained that offers excellent legibility and which can easily be adapted to an existing mechanism. This can be appreciated by comparing the respective illustrations of FIG. 4*a*, which represents a simplified view of a timepiece 100 comprising a display 106 according to the state of the art, and of FIG. 4*b*, which represents a simplified view of a timepiece 1 comprising a display 6 according to the present invention.

The implementation of the present invention is not limited to the display of the date. Indeed, the person skilled in the art will not have any particular difficulty in adapting the present teaching to the implementation of a mechanism for displaying an information other than the date, whether it be displayed by numbers, words or even by symbols of variable width, such as, for example, the phases of the moon.

The above description seeks to describe a particular embodiment by way of nonlimiting illustration and the invention is not limited to the implementation of certain particular features which have just been described, such as, for example, the construction of the actuation mechanism as described and illustrated. Indeed, as mentioned above, the above disclosure allows the person skilled in the art to produce a wide variety of display mechanisms, comprising indications of variable width and separation spaces between them, all substantially of the same width, according to specific requirements thereof, with no difficulty and, thereby, without departing from the scope of the present invention.

Finally, it will also be noted that, based on the type of construction implemented, the person skilled in the art will be able to produce a dragging or jumping display according to his or her specific needs.

What is claimed is:

1. A timepiece, comprising:

a display mechanism arranged to control movements of a display organ with respect to an indication scale comprising different indications having at least two different widths and being separated from one another by corresponding separation spaces, wherein said indications are oriented along a direction of extension of said indication scale, wherein said separation spaces all have substantially one and a same width, and the widths of said indications and the width of said separation spaces being measured along the direction of extension of said indication scale.

2. The timepiece of claim 1, wherein said display mechanism comprises a display mobile arranged to control movements of said display organ, and an actuation mechanism arranged to cooperate with the display mobile and to move the display mobile along different successive positions associated with said indications, in such a way that said different successive positions have between them at least two different pitches.

3. The timepiece of claim 2, wherein said actuation mechanism comprises a cam against which a feeler-spindle is arranged to bear, said feeler-spindle being linked kinematically to said display mobile, a length of said cam having at least two different slope values along so that said display mobile can be driven in rotation according to two different pitch values for one and same angle of rotation of said cam as a function of an orientation of said cam with respect to said feeler-spindle.

4. The timepiece of claim 3, wherein said indications indicate a date.

5. The timepiece of claim 2, wherein said actuation mechanism comprises a first and a second partner wheels defining a non-circular meshing, or a first partner wheel of a non-circular meshing, said display mobile comprising a second partner wheel of said non-circular meshing, said first and second partner wheels being arranged in such a way that they mesh with one another with a variable gear ratio, and that said display mobile is driven according to at least two different pitches.

6. The timepiece of claim 5, wherein said indications indicate a date.

7. The timepiece of claim 2, wherein said display mobile comprises gear teeth having at least two different pitches and arranged to cooperate with an actuation mobile of said actuation mechanism, and with a jumper to position and hold said display mobile, said gear teeth being indexed on the position of said indication scale.

8. The timepiece of claim 7, wherein said actuation mobile and said jumper are arranged in such a way that said actuation mobile actuates one of teeth with which said jumper cooperates to move said display organ.

9. The timepiece of claim 8, wherein said gear teeth, or each of said first and second gear teeth, have at least three different pitches.

10. The timepiece of claim 9, wherein said indications indicate a date.

11. The timepiece of claim 8, wherein said indications indicate a date.

12. The timepiece of claim 7, wherein said gear teeth, or each of said first and second gear teeth, have at least three different pitches.

13. The timepiece of claim 7, wherein said indications indicate a date.

14. The timepiece of claim 7, wherein said indications have three different widths.

15. The timepiece of claim 2, wherein said display mobile comprises first and second gear teeth each having at least two different pitches, said first gear teeth being arranged to cooperate with a jumper to position and hold said display mobile, said second gear teeth being arranged to cooperate with an actuation mobile of said actuation mechanism, said first and second gear teeth being indexed on the position of said indication scale.

16. The timepiece of claim 15, wherein said gear teeth, or each of said first and second gear teeth, have at least three different pitches.

17. The timepiece of claim 2, wherein said indications indicate a date.

18. The timepiece of claim 2, wherein said indications have three different widths.

19. The timepiece of claim 1, wherein said indications indicate a date.

20. The timepiece of claim 1, wherein said indications have three different widths.

* * * * *